US007963463B2

(12) United States Patent
Breedlove et al.

(10) Patent No.: US 7,963,463 B2
(45) Date of Patent: Jun. 21, 2011

(54) COMPRESSED AIR FOAM AND HIGH PRESSURE LIQUID DISPERSAL SYSTEM

(75) Inventors: John David Breedlove, Boulder, CO (US); Dennis Edward Smagac, Boulder, CO (US); Seth Robert Mayer, Broomfield, CO (US); Thomas Anthony Licht, Lafayette, CO (US); James Theodore Wilkinson, Highlands Ranch, CO (US)

(73) Assignee: Intelagard, Inc., Broomfield, CO (US)

( * ) Notice: Subject to any disclaimer, the term of this patent is extended or adjusted under 35 U.S.C. 154(b) by 764 days.

(21) Appl. No.: 11/105,290

(22) Filed: Apr. 13, 2005

(65) Prior Publication Data

US 2006/0231644 A1 Oct. 19, 2006

(51) Int. Cl.
*F23D 11/16* (2006.01)

(52) U.S. Cl. ..... 239/422

(58) Field of Classification Search ..... 239/398, 239/128, 134, 337, 310, 311, 366–369, 302, 239/8, 422; 169/43, 44, 14, 71, 15, 9, 30, 169/85

See application file for complete search history.

(56) References Cited

U.S. PATENT DOCUMENTS 3,799,451 A * 3/1974 Kollmai ..... 239/444
5,411,100 A * 5/1995 Laskaris et al. ..... 169/14
5,623,995 A * 4/1997 Smagac ..... 169/30
5,803,596 A * 9/1998 Stephens ..... 366/10
6,109,359 A * 8/2000 Ballard ..... 169/14
6,155,351 A * 12/2000 Breedlove et al. ..... 169/14
6,276,459 B1 * 8/2001 Herrick et al. ..... 169/14
6,405,626 B1 * 6/2002 Bureaux et al. ..... 86/50

* cited by examiner

*Primary Examiner* — Davis Hwu
(74) *Attorney, Agent, or Firm* — Patton Boggs LLP

(57) ABSTRACT

The compressed air foam and high pressure liquid dispersal system provides a compressed air foam product in addition to concurrently producing a liquid under pressure for decontamination, general cleaning, vapor suppression, Hazmat remediation, fuel spills, and fire suppression support for durable equipment, vehicles, terrain, facilities, and aircraft. The system includes a power plant for powering the compressed air foam and high pressure liquid sub-systems of the system. The high pressure sub-system further includes a boiler for heating the liquid to a temperature above ambient temperature. The boiler and power plant may use the same type of fuel for decreasing the number of fuel supplies to the system. In addition, the power plant drives an air compressor for providing compressed air for powering the compressed air foam sub-system. The power plant further drives a high pressure water pump for pressurizing the water for the high pressure sub-system. The system includes additional features such as an air chuck that feeds off of the compressed air supply for powering pneumatic tools and inflating flat tires present during such cleaning and decontamination. Also, the system includes a 24 VDC electrical system for charging stalled vehicles and the like present during operations.

41 Claims, 7 Drawing Sheets

COMPRESSED AIR FOAM AND HIGH PRESSURE LIQUID DISPERSAL SYSTEM

FIELD OF THE INVENTION

This invention relates broadly to the field of dispersing foam and high pressure liquids, and more particularly relates to a compressed air foam and high pressure, low volume liquid dispersion system for decontamination, general cleaning, vapor suppression, fuel spills, and fire suppression applications.

PROBLEM

It is a problem in the field of decontamination operations, which are often executed in remote locations, to clean the dirt and mud or other materials off of the surface of the contaminated unit prior to decontaminating the unit. These contaminated units may be rolling stock, such as trucks and the like, or non-rolling stock, such as equipment, buildings and storage sheds. Dirt and mud or other materials may be coated on a surface of a unit that has also been contaminated by the intentional or unintentional application of a contaminating agent, such as a chemical, biological, radiological, and nuclear (CBRN) agent. Typically, the rolling stock is driven to a decontamination line, which has been deployed in the remote location, where it is cleaned in a first stage of the decontamination line with a high-pressure power washer system that outputs hot water or a bleach and water mixture. Then, the rolling stock is further driven down the decontamination line to a second stage where a separate decontamination system sprays a decontaminant on the rolling stock. Thus, this decontamination line requires at least two separate and independent systems to be deployed in the decontamination operation.

Typically, high-pressure power wash systems are used to power wash the dirt and mud from the units. The high-pressure power wash systems presently employed include heated and non-heated high-pressure spray systems that use heated and non-heated liquids as the cleaning fluids. These liquids can be water or decontamination solutions to be used in the field of operation. To heat the water or decontamination solutions in a remote location requires additional equipment in the existing decontamination systems, such as large boilers, to be transported to the remote location. Further, typical high-pressure systems designed for use with water do not generally work with other liquids, such as decontamination solutions. Moreover, they generally are not designed to heat water and other liquids, such decontamination solutions, which both generally are more effective when heated than not heated. Hot water is a more effective cleaning agent than cold water and heated decontamination solutions generally are more effective when they are heated than when they are not.

These remote locations typically are not equipped with cleaning and decontamination systems, such as high-pressure power wash sprayers and decontamination solution application sprayers, which are required to effectively implement a decontamination line. Thus, to properly clean and decontaminate units, such as military rolling stock or fire fighting equipment, in remote locations, significant amounts of time and energy must be expended to transport these individual high-pressure wash and decontamination solution application systems to these remote locations for use in deploying a decontamination line.

In addition, many of the decontamination formulas used in the decontamination systems are compositions of two or more individual compositions or solutions that have shelflives of several years, but when the individual compositions come in contact with each other in a mixture, the shelf life of the mixture decreases significantly, down to a duration of hours with some mixtures. Once these mixtures go past their expiration time, they can not be used for their intended use and must be properly disposed. Also, some favorable decontamination formulas are foams that require specific expansion ratios to provide maximum decontamination effectiveness. For example, some preferable decontamination formulas require an 8:1 expansion ratio for optimal effectiveness. This means that the decontamination solution application systems must deliver the decontamination formula at a specific mixture with compressed air to provide the 8:1 expansion ratio. If the application parameters are improperly set or are not achievable at the outset, then the specific decontamination formula is delivered to the contaminated unit as a watery solution or liquid, instead of the ideal foam. These parameters are difficult to meet in remote locations.

Further, where these power wash and decontamination units are used in remote locations far away from the base operations, the cleaning and decontamination operations are not usually performed efficiently because all of the systems that are required may not be available, the available systems may not be properly sized for the present task, there may be a shortage of the necessary liquids, such as water for power washing the contaminated unit, as well as other factors that negatively impact the operation of the decontamination line.

Additionally, these cleaning and decontamination operations can become stalled because of rolling stock with dead batteries or flat tires. The dead batteries are then charged and flat tires inflated by yet other pieces of equipment that must be transported to the decontamination line, and this additional equipment may itself become contaminated from contact with the contaminated rolling stock.

Therefore, there is a need for an integrated compressed air foam (CAF) and high pressure liquid dispersal system that provides an effective means for cleaning, decontaminating, and fire and vapor suppressing, while providing transportability and scalability.

SOLUTION

The above-described problems are solved and a technical advance is achieved in the art by the present compressed air foam and high-pressure liquid dispersal system, termed "CAF/HPLD system" herein. The CAF/HPLD system includes a multi-fuel engine, air compressor, high pressure sub-system, heater, and a compressed air foam sub-system. The CAF/HPLD system is an integrated system that is easily transportable and which can be used in remote locations for decontamination, general cleaning, vapor suppression, Hazmat remediation, fuel spills, and fire suppression. In one aspect, the CAF/HPLD system provides decontamination support for durable equipment, vehicles, terrain, facilities, and aircraft. The CAF/HPLD system can be used with standard CBRN decontamination formulas and standard fire suppression and Hazmat foams as well. The CAF/HPLD system further dispenses liquids such as hot and cold soapy water and glycol-based de-icing fluid.

The CAF/HPLD system drafts two-part (binary) or multiple-part formulas directly into the compressed air foam (CAF) sub-system for dispersal through a handset hose. Interchangeable nozzles allow for straight stream throw, wide angle rapid foam coverage, effective liquid application, and easy rolling stock undercarriage wash. The CAF/HPLD system also simultaneously powers twin high-pressure hoses for powerful hot/cold wash-down capability. A chemical induction system allows a user to introduce soaps and other chemicals into the high-pressure stream.

The present CAF/HPLD system includes a high-pressure low volume sub-system that functions by heating a liquid to a temperature above the ambient temperature of the liquid. The CAF/HPLD system is designed to heat a liquid to a high enough temperature to further increase the beneficial use of the CAF/HPLD system.

Further, the compressed air foam sub-system provides an efficient foam delivery system. The water/foam mixture uses commercially available foaming agents that are expanded by the application of the pressurized gas and the optional use of a foam expansion element to create the fire suppressant foam may or may not use additional pressurized water as a propellant. This has multiple benefits, including the reduction in the moisture content of the fire suppressant foam, vapor suppressant foam, or decontamination foam and avoiding the need for complex water pumping apparatus to create the stream of pressurized water. The elimination of water as a delivery agent thereby renders this apparatus independent of a large supply of water that is typically needed for fire fighting or decontamination purposes. In addition, since water is an incompressible medium, it storage and delivery cannot be improved by pressurization, whereas the use of a gas, such as compressed air, provides great opportunity for storage efficiency, since the gas can be pressurized to extremely high levels, thereby efficiently generating and storing a vast quantity of propellant in a small physical space. Similarly, the use of a pressurized gas powered pumping system to increase the pressure of the delivered water/foam mixture does not unduly complicate the apparatus since pumps of low weight and sizes are available for this purpose. The resultant apparatus is therefore lightweight, compact in dimensions and inexpensive to implement. Control of the flow of the pressurized gas and water/foam mixture is accomplished by way of simple valves and pressure regulators, thereby eliminating the complex apparatus presently in use.

In addition, the compressed air foam sub-system uses two pumps or multiple pumps to keep the solutions separate prior to spraying. This prevents the unnecessary disposal of an expired mixture and requiring additional time and energy to dispose of the mixture. A first pump is used to pump a water and soap solution (Component 1) and a second pump is used to pump a second decontamination solution component, such as a peroxide solution. These two pumps then pump their respective solutions to an outlet tube, such as a sprayer, that then applies the properly mixed solution to the decontaminated units concurrently. These pumps further provide precise mixing ratios of the different solutions for optimal cleaning and decontamination operations. In addition, because the decontaminant components are stored individually and are mixed on demand, precise mixing ratios can be produced and later modified or changed instantly in the field.

In addition, due to its transportability the CAF/HPLD system provides simultaneously a high-pressure sub-system and a compressed air foam sub-system for efficient cleaning and decontamination functionality in a remote location. Both subsystems can be used concurrently, thus one piece of soiled rolling stock can be cleaned with the high-pressure sub-system at the same time that a piece of rolling stock can be decontaminated with the CAF sub-system.

Further, since the present CAF/HPLD system runs on 24 volt (or optionally 12 volt) direct current (VDC), it is capable of jump-starting dead batteries on stalled vehicles found on the decontamination line. This saves an enormous amount of time and energy by not having to transport another piece of equipment, namely a battery charger, to the decontamination line. Additionally, since the present CAF/HPLD system includes an air compressor, emergencies, such as flat tires, can be dealt with quickly without requiring yet another piece of equipment being transported to the decontamination line. Furthermore, pneumatic tools, such as extraction tools, can be driven off of the air compressor as well.

The novel CAF/HPLD system combines the benefits of a compressed air foam sub-system with a high-pressure power wash system, including a boiler for heating water or any other desired liquid, to provide an effective and easily transportable cleaning and decontamination system.

SUMMARY

The invention provides a compressed air foam and high pressure liquid dispersal system including: a compressed air sub-system including components for delivering water and foam concentrate mixtures from a first tank to a mixing apparatus, components for delivering a product additive, other than water, from a second tank to the mixing apparatus, components for mixing the water and foam concentrate mixture and the product additive to produce a foam liquid mixture; components for injecting compressed air into the mixing apparatus to produce the compressed air foam; components for delivering the compressed air foam; and a high pressure sub-system, that includes: components for delivering a liquid from a liquid reservoir to the high pressure sub-system; components for generating a high pressure liquid; components for delivering a flow of the high pressure liquid; and a power plant to power the compressed air foam sub-system and high pressure sub-system.

Preferably, the components for delivering the water and foam concentrate mixtures from a first tank to the mixing apparatus and the components for delivering a product additive, other than water, from a second tank to the mixing apparatus includes: a first pump powered by the power plant to draw the water and foam concentrate mixture and the product additive, other than water, at a controllable rate and pressure. Preferably, the first and second pumps are powered by a supply of pressurized gas; and a pressurized gas operated pumps operated from the supply of pressurized gas to draw the water and foam concentrate mixture and the product additive, other than water, at the controllable rate and pressure. Preferably, the supply of pressurized gas includes an air compressor powered by the power plant for supplying the supply of the pressurized gas. Preferably, the components for delivering the liquid from a liquid reservoir to the high pressure sub-system includes a third pump powered by said power plant to draw said liquid at a controllable rate and high pressure. Preferably, the high pressure sub-system includes the third pump. Preferably, the components for delivering the high pressure liquid further includes a heating element to heat the high pressure liquid to a temperature above ambient temperature. Preferably, the heating element includes a high pressure liquid boiler. Preferably, the high pressure liquid boiler further includes supplying a fuel to the burners of the high pressure liquid boiler for the operation of the high pressure liquid boiler for heating the high pressure liquid. Preferably, the power plant includes an internal combustion engine. Preferably, the internal combustion engine further includes supplying a fuel for the operation of the internal combustion engine.

These and other features, aspects, and advantages of the present invention will become better understood with regard to the following description, appended claims, and accompanying drawings.

DETAILED DESCRIPTION OF THE DRAWINGS

In accordance with the present compressed air foam and high-pressure liquid dispersal system ("CAF/HPLD System"), the CAF/HPLD system 100 is easily transportable and can be used in remote locations for decontamination, general cleaning, vapor suppression, Hazmat remediation, fuel spills, and fire suppression. In one aspect, the CAF/HPLD system 100 provides decontamination support for durable equipment, vehicles, terrain, facilities, and aircraft. The CAF/HPLD system can be used with standard CBRN decontamination formulas and standard fire suppression and Hazmat foams as well. When used as a decontamination system, the CAF/HPLD system 100 allows the user to effectively apply decontaminant for interior and exterior building applications as well as contaminated ground, pavement, equipment, and vehicles. An optional shower system is available that provides that provides shower stations for multiple personnel.

The CAF/HPLD system further dispenses liquids such as hot and cold soapy water and glycol-based de-icing fluid. In addition to other components, including structural, mechanical, and electrical components, the CAF/HPLD system 100 preferably includes four sub-systems: a high pressure sub-system, a compressed air foam sub-system, a compressed air sub-system, and fuel sub-system.

In addition, compressed air foam (CAF) means a type of foam made by injecting compressed air into a foamable liquid solution as it exits the pumping apparatus and flowing expanded foam through the delivery hose, such as the two (or three) constituents of DF200 or the three components of Reformulated Decon Green or other decontaminant formulations. Expansion ratio means the volumetric ratio of liquid volume present prior to expansion to foam volume created after expansion. A 1:1 ratio means the liquid has not been expanded. A 15:1 ratio means the liquid has been expanded to 15 times its original volume. Also, gallons per minute (GPM) is a unit of measure for pumping throughput through a system and pounds per square Inch (PSI) is a unit of measure for pressure. Cubic feet per minute is a unit of measure for air or liquid throughput. Hydraulic lines are designed to carry pressurized fluid and pneumatic lines are designed to carry pressurized air.

Overview

Figure 1:
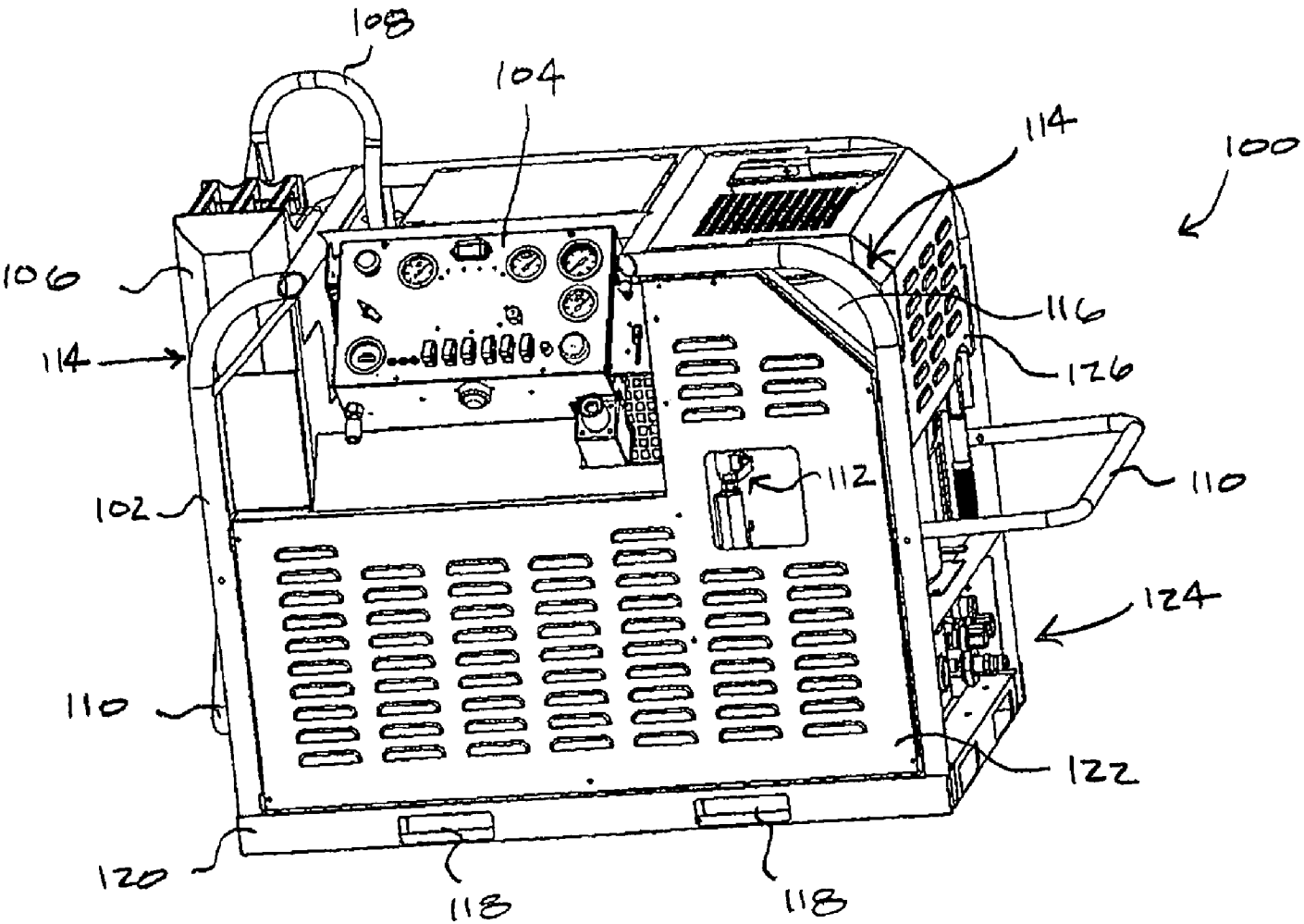
FIG. 1 illustrates an isometric front view of an embodiment of a compressed air foam and high pressure liquid dispersal system of the present invention.
Figure 2:
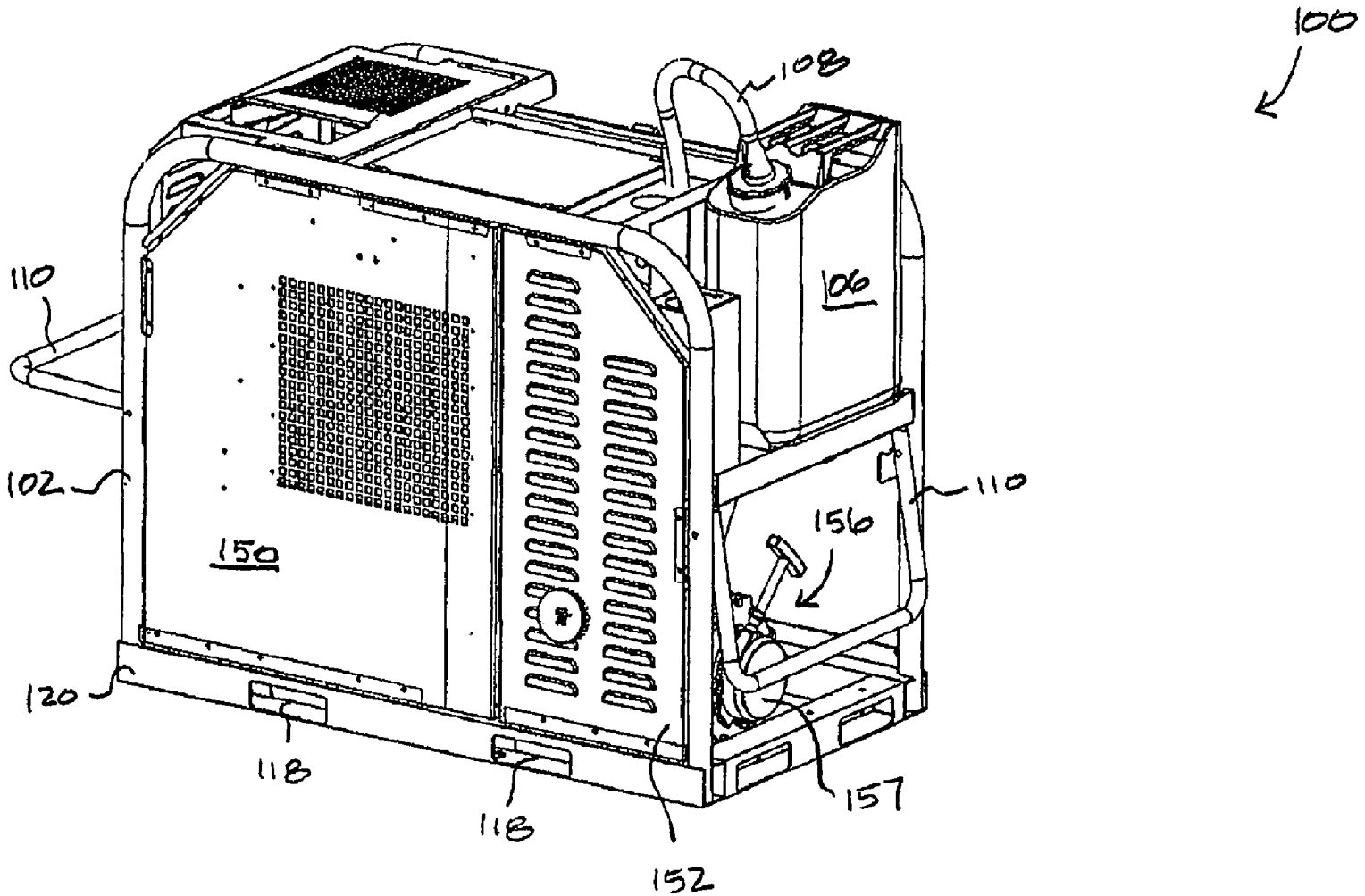
FIG. 2 illustrates another isometric back view of the embodiment of the compressed air foam and high pressure liquid dispersal system of FIG. 1 of the present invention.
Figure 3:
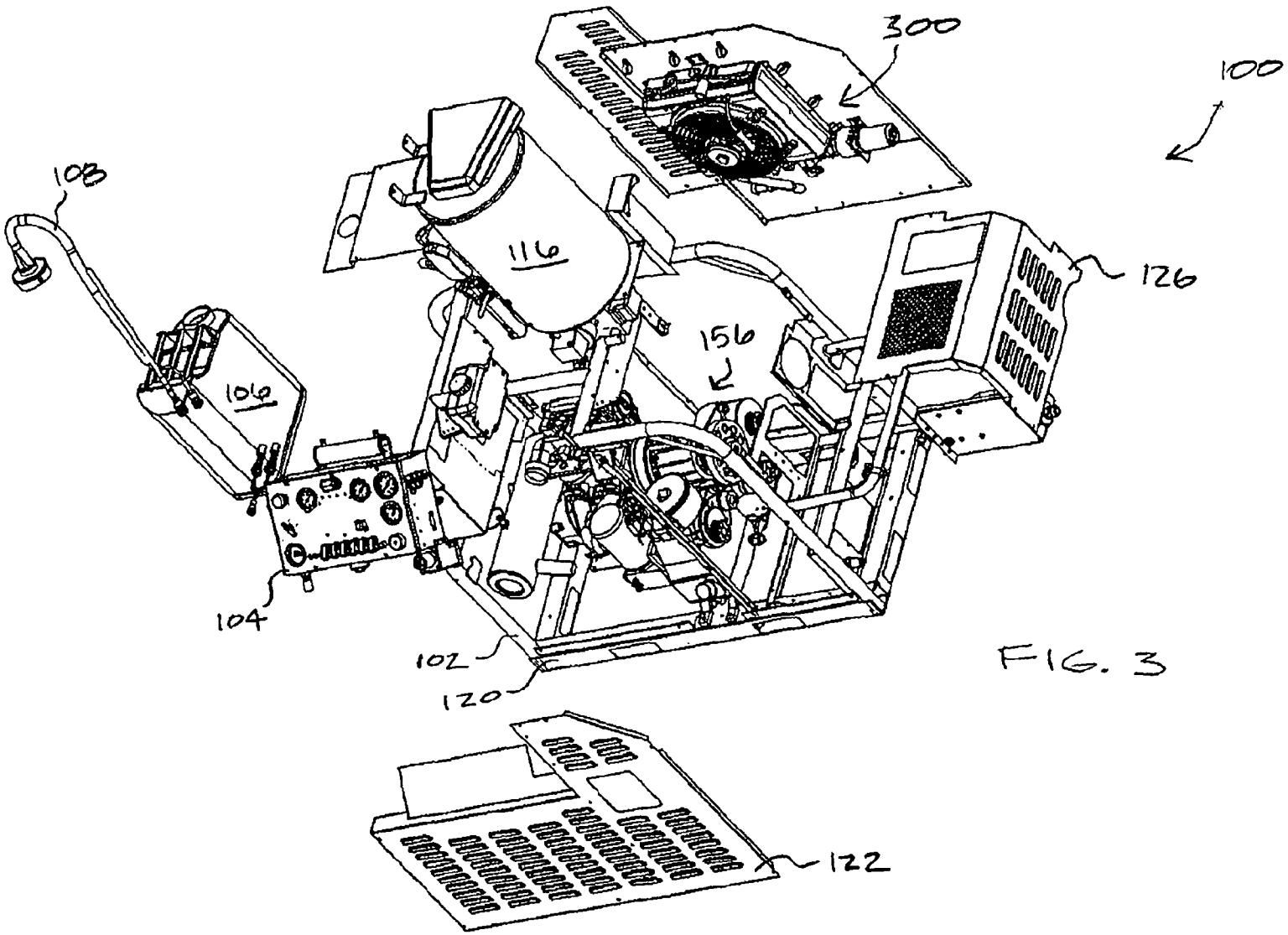
FIG. 3 illustrates an exploded isometric view of the front view of the embodiment of a compressed air foam and high pressure liquid dispersal system of FIG. 1 of the present invention.

FIG. 1 illustrates an embodiment of the CAF/HPLD system 100 including a frame 102, lifting bars 110, lifting sling accesses 114, base 120 including forklift slots 118 for forklift access, and front panel 122 and side panel 126 for enclosing many of the components and sub-systems of the CAF/HPLD system 100. In addition, CAF/HPLD system 100 further includes a control panel 104, fuel can 106, fuel delivery line 108, high pressure emergency shut-off 112, boiler 116, and plumbing connection manifold 124. FIG. 2 illustrates a rear panel 150, and cooling panel 152 for the radiator assembly contained behind the cooling panel. Power plant 156 provides the power and pumps for many of the sub-systems of the CAF/HPLD system 100. Power plant 156 includes an engine 157, air compressor, and high pressure pump. FIG. 3 further illustrates for the compressed air foam sub-system 200. Power plant 156 preferably further includes an alternator.

The lifting bars 110 are each intended to accommodate preferably two to three personnel. Since there is one lifting bar 110 on each end of the CAF/HPLD system 100, the system is designed to be lifted by a total six people, three on each lifting bar 110. The forklift slots 118 preferably feature 4-way forklift access.

Sub-Systems

Figure 4:
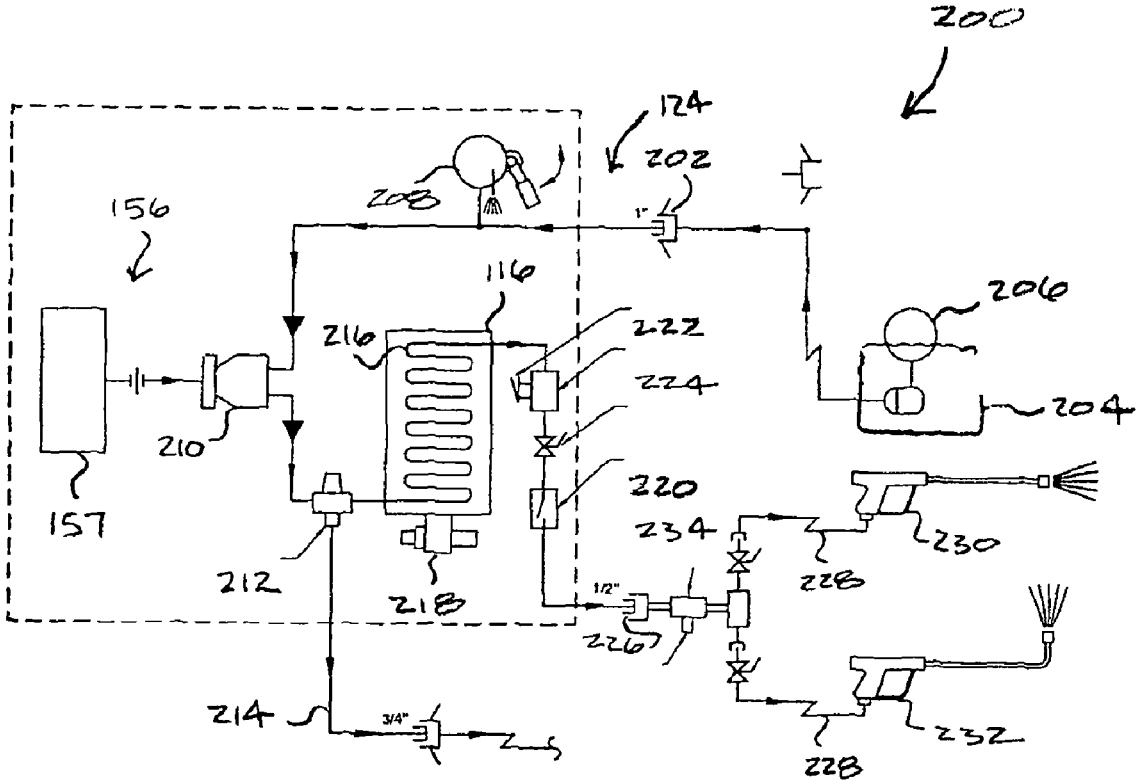
FIG. 4 illustrates in block diagram form one embodiment of a high pressure wash sub-system of the compressed air foam and high pressure liquid dispersal system of the present invention.

FIG. 4 illustrates in block form an embodiment 200 of the high pressure sub-system. In this embodiment, the high pressure sub-system 200 preferably provides up to 5.5 gpm flow at 1000 psi for washing heavily soiled surfaces such as dirt and mud caked on a vehicle or building. Other gpm and psi settings may be used as well with the high pressure sub-system 200. Soap and other solutions may be added to the wash water and the wash water may be heated to provide higher levels of wash efficiency. Water is drafted to the high pressure sub-system 200 via the high pressure inlet 202 at the plumbing connection manifold 124. In one aspect, this port is a coupler, such as a 1" cam lever coupler. Preferably, a drafting hose is provided to connect to the nearest water source 204. Accessories include adapters for connection to a tote, fire hydrant (optional) or from an open water source such as an open water tank, pond or river. Included are a float and a foot valve 206 with strainer for obtaining water from an open water source.

A hand pump 208 for priming the high pressure pump 210 is provided should the water source be located below the high pressure sub-system 200. In one aspect, the hand pump 208 preferably allows drafting of up to 20 vertical feet when the foot valve 206 is used on the suction hose inlet or 12 vertical feet without the foot valve.

The high-pressure pump 210 is capable of pumping brackish water and slurries and is therefore an ideal pump for low quality water sources. In this embodiment, the high pressure pump 210 is set at a high discharge pressure, such as a 1000 psi by incorporating a pressure relief valve 212 at the pump discharge. Whenever full flow is not being used the pressure will build over 1000 psi and the relief valve 212 will return a portion of the flow to the water source 204 via an overflow hose 214. In this embodiment, the overflow connection may be a coupling, such as a ¾" cam lever coupling located directly below the high pressure inlet 202 on the plumbing connection manifold 124 is discharged from the high-pressure pump 210 after passing through a heating coil 216 in the boiler 116. If desired, water can be heated up to higher than the ambient water temperature, such as 107° F. above ambient. In another embodiment, the high pressure pump 210 can have greater or lesser power output ratings, or additional high pressure pumps 210 can be used together to provide desired water output.

The boiler burner 218 provides heat for the high pressure sub-system 200. In this embodiment, the boiler 116 is capable of providing sufficient heat to warm 5.5 gpm of water through a 107° F. temperature differential. To increase or decrease the heating capacity of the boiler 116, larger or smaller sized boilers 116 may be substituted to achieve the desired heating capacity. In addition, sequential and multi-stage boilers may also be used to achieve the desired heating capacity.

The boiler 116 is preferably a single pass parallel flow boiler 116 with an insulated outer jacket. Water enters the boiler 116 at the bottom and flows through a pipe, such as a ⅜-inch pipe in the heating coil 216. A burner 218 at the bottom of the boiler 116 directs a flame upward through the heating coil 216 to heat the water. Hot exhaust air leaves the boiler at the top and is directed to the back side of the CAF/HPLD system 100. An exemplary burner 218 is a Beckett Model ADC 24 VDC oil burner that can burn JP8, JP5, and commercial diesel fuels (DF-1 and DF-2). In this embodiment, the burner 218 uses a ⅙ hp, 10 amp blower operating at 3450 rpm and burns fuel in a F16 burner head at the rate of 1.65 gph at full operation. Fuel is pumped to the burner head by a mechanical pump located in the burner head assembly.

As an example, assuming a typical groundwater temperature of 45° F., the hot water discharge would be approximately 150° F. and inlet water at 32° F. could be heated to about 140° F. The user sets water temperature by adjusting the temperature control to the desired temperature on the control panel 104. Water temperature is displayed by the temperature gauge located above the temperature control on the control panel 104. The burner 218 preferably has an automatic spark igniter (not shown) that will light the fuel-air mixture upon heating demand. A demand for heat also turns on a fan and opens the fuel valve to the burner. The burner will cycle on and off to maintain the desired temperature setting. Preferably, a flow switch 220 will shut down the heat if no flow is detected. This safety feature prevents the boiler 218 from over-heating and possibly bursting. Preferably, a rupture disk 222 is installed in the system to burst if pressure exceeds a preset pressure setting, such as 1500 psi. The burner 218 obtains its fuel from the same source as the power plant 156 and is preferably capable of burning JP8, JP5 and commercial diesel fuels (DF-1 and DF-2). At lower flows, steam may be generated.

Water exiting the boiler is then routed to the high pressure discharge 224 of the high pressure sub-system 200, which is located on the plumbing connection manifold 124. A coupling 226, such as ½-inch quick connect coupling is used for connection to the high pressure hoses 228 and wands 230, 232. The injector 234 allows soap and other liquids to be drawn into the high pressure sub-system 200. A solution, such as a 12% solution can be added to the high pressure sub-system 200. Two high pressure hoses 228 connect from the "Y" fitting to the spray wands 230, 232. A plug fitting may be used should only one spray wand 230 be used. The high pressure wands 230, 232 have a trigger handle that must be squeezed to spray fluids. Preferably, there is no locking mechanism on the trigger as a preventative safety measure. Also, preferably, the high pressure wands 230, 232 have a splash back shield and a continuously adjustable nozzle from 0-degrees to a 45-degree fan spray. High pressure wand 232 preferably has an undercarriage attachment with 45-degree fan spay nozzle for facilitating rapid cleaning of the underside of vehicles. A high-pressure emergency shut off valve 112 is located just right of the front panel 122. It is recessed to an area behind the front panel 122. To activate, a user simply reaches in the hole provided and lifts up to turn off the high pressure flow. Preferably, the high pressure shut off valve stops flow in the boiler water circuit and will also automatically shut off the burner because the flow switch will de-energize the burner unit.

Figure 5:
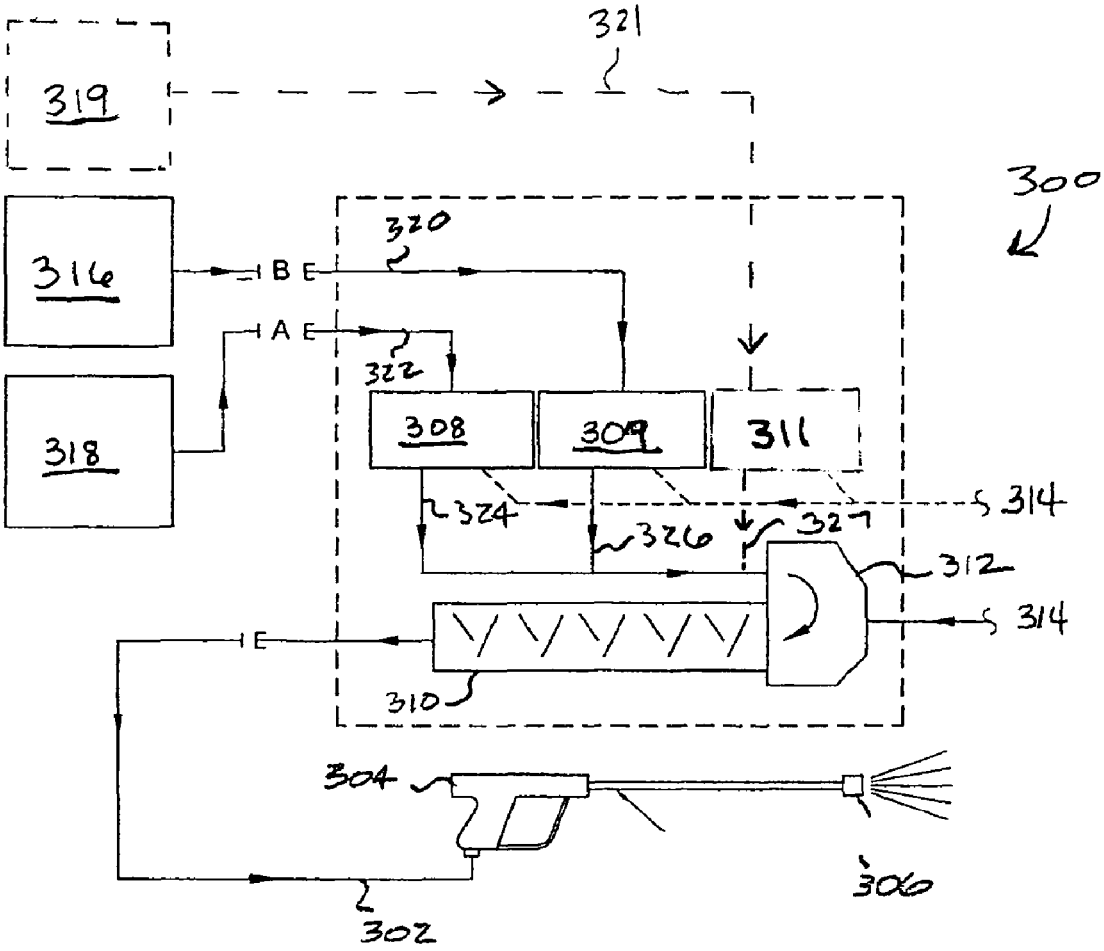
FIG. 5 illustrates in block diagram form one embodiment of a compressed air foam sub-system of the compressed air foam and high pressure liquid dispersal system of the present invention.

FIG. 5 illustrates in block form an embodiment 300 of the compressed air foam sub-system ("CAF sub-system"). The CAF sub-system 300 incorporates a mix-on-demand technology that can be found in U.S. Pat. No. 5,623,995, issued 29 Apr. 1997 to Smagac; U.S. Pat. No. 6,267,183 issued 31 Jul. 2001 to Smagac; and U.S. Pat. No. 6,155,351 issued 5 Dec. 2000 to Breedlove et al., all of these references are incorporated herein by reference. This mix-on-demand technology allows decontaminants to have the maximum pot or shelf life as the components are mixed upon demand rather than having to be premixed in a bulk container and subsequently degrading while awaiting use.

This mix-on-demand technology provides drafting in precise ratios of two-part or multiple-part solutions and mechanical mixing within the CAF sub-system 300. The CAF sub-system 300 preferably provides 10-gpm liquid flow or greater at 100 psi and furnishes adjustable expansion rates such as, 1:1 (liquid), 8:1 (foam), 15:1 (foam), and 25:1 (foam). Dispersal is through a hose, such as a 75-foot hose with wand 304 and nozzle 306 fed by line 302. Interchangeable wands 304 and nozzles 306 allow a variety of spray patterns for foam delivery.

The air compressor 314 of the power plant 156 provides power for the CAF/HPLD system's 100 fluid or foam decontaminant delivery. The power plant 156 provides: compressed air that combines with a surfactant (soap) based liquid to create foam; the pressure to propel the resulting foam or unexpanded liquid from the nozzles 306; the air to operate the diaphragm pumps of the CAF sub-system 300; and compressed air that may be used to air tires or run air powered tools, such as pneumatic tools.

In this embodiment, the CAF pumps 308 and 309 and mixing manifold are located on the boiler end and rear corner side of the CAF/HPLD system 100 as depicted in FIG. 3. The CAF pumps 308 and 309 are preferably each a diaphragm pump that draws equal amounts of decontaminant liquid from source A tote 316 and source B tote 318. Those solutions with mixed ratios other than 50/50, the flow rates of the individual pumps 308, 309, and optionally 311 can be controlled by regulating air flow to the pumps 308, 309, and optionally 311 or regulating the liquid intake or output. Thus, such ratios as 30/30/40 can be accomplished precisely and accurately. In another embodiment, an additional CAF pump 311 is used to pump from an optional source C tote 319. CAF pump 311 is also preferably a diaphragm pump. CAF pumps 308, 309, and 311 may alternatively be other types of pumps capable of pumping liquid from totes 316, 317, and 319. In yet another embodiment, additional totes and CAF pumps, such as four or five totes and associated pumps may be employed to provide further multi-part formulation flexibility to the CAF/HPLD system 100.

The CAF pumps 308, 309 and optionally 311 begin the mixing process of components A tote 316, B tote 318, and optionally source C tote 319 and propel, via lines 324, 326, and optionally 327 respectively, the resulting fluid to a mixing manifold 312 and then to a static mixing system 310 where further mixing takes place. This ensures that the liquid decontaminants from source A tote 316, source B tote 318, and source C tote 319 are not mixed together until they are needed in the field, thus providing maximum shelf or pot life for the decontaminants. Decontaminant liquid from source A tote 316, source B tote 318, and source C tote 319 are provided to CAF pumps 308 via drafting hoses 322 and 320, respectively.

Air, provided by air compressor 314, is injected into the mixture to create foam and expand the mixture. The CAF sub-system 300 preferably includes a foam expansion/dispersal valve that is located on the control panel 104 and is used to control the level of foam expansion. The levels are indicated as a ratio of air-to-liquid. Air-to-liquid ratios of such as 1:1, 8:1, 15:1 and 25:1 in addition to others are possible with the CAF sub-system 300.

In addition to these air-to-liquid ratios, any other precise ratios may be used with the present CAF/HPLD system 100. In one embodiment, the precise air-to-liquid ratios can be achieved by adjusting or metering the flow of liquid through the pumps 308, 309 and optionally 311 individually. In one aspect, this can be achieved by the use of needle valves (not shown) located downstream from pumps 308, 309 and optionally 311. In another embodiment, these precise ratios can be achieved by limiting the amount of air that is fed to pumps 308, 309 and optionally 311.

In another embodiment, one CAF pump 308 begins the mixing process of components A tote 316 and B tote 318 and propels, via lines 324 and 326 respectively, the resulting fluid to a mixing manifold 312 and then to a static mixing system 310 where further mixing takes place. This ensures that the liquid decontaminants from source A tote 316 and source B tote 318 are not mixed together until they are needed in the field, thus providing maximum shelf or pot life for the decontaminants. In this embodiment the two components, A tote 316 and B tote 318, are provided in equal ratios to each other to CAF pump 308 via drafting hoses 322.

Another aspect of the CAF sub-system 300 is that the mixed liquid ratios may be heated to a temperature to provide optimal efficacy of the compressed air foam upon application. In one embodiment, line 302 can be in contact with boiler 116 prior to being dispersed by the wand 304 and the nozzle 306. In another embodiment, line 302 can be in contact with a heat exchanger that is also in contact with the exhaust manifold (not shown) of the engine 157.

The air compressor 314 of the power plant 156 generates the pneumatic power that operates the CAF pumps 308, pressurizes the liquid decontaminant and expands the decontaminant into foam to be dispensed from the CAF/HPLD system 100. The air compressor 314 is driven by the multi-fuel engine 157 of the power plant 156. In one aspect, the engine 157 is a multi-fuel 27 horsepower internal combustion engine 157. The power rating and size of the engine 157 may be increased, decreased, or changed to fit the desired application. An exemplary pump 210 is the Hydra-Cell D-10 series high-pressure diaphragm pump manufactured by Wanner Engineering of Minneapolis, Minn. The air compressor 314 may be engaged by a clutching means, such as an electric clutch, mechanical clutch, pneumatic clutch, or centrifugal clutch. In one embodiment, the air compressor 314 is driven by a jack shaft that is a direct drive between the engine 157 and air compressor 314 and that does not include any clutching means. In this embodiment, the air compressor 314 is a rotary screw compressor that delivers 28 CFM at a pressure of 100 psi. The air compressor 314 is encapsulated in that the oil separator, filters, pressure regulation, temperature and pressure safety valves and blow-down valves are self-contained in the compressor unit. Encapsulation reduces the leak potential, weight, and size of the compressed air system.

The air compressor 314 may use automatic transmission fluid as a coolant and lubricant. Typically, coolant is circulated to a fan-cooled cooling coil on the CAF/HPLD system's cooling panel 152 whenever the air compressor 314 is engaged. Compressed air is supplied to the CAF pumps when the Mode Selector switch is in the CAF mode. Expansion air is controlled by the adjustment valve located on the control panel 104.

Figure 6:
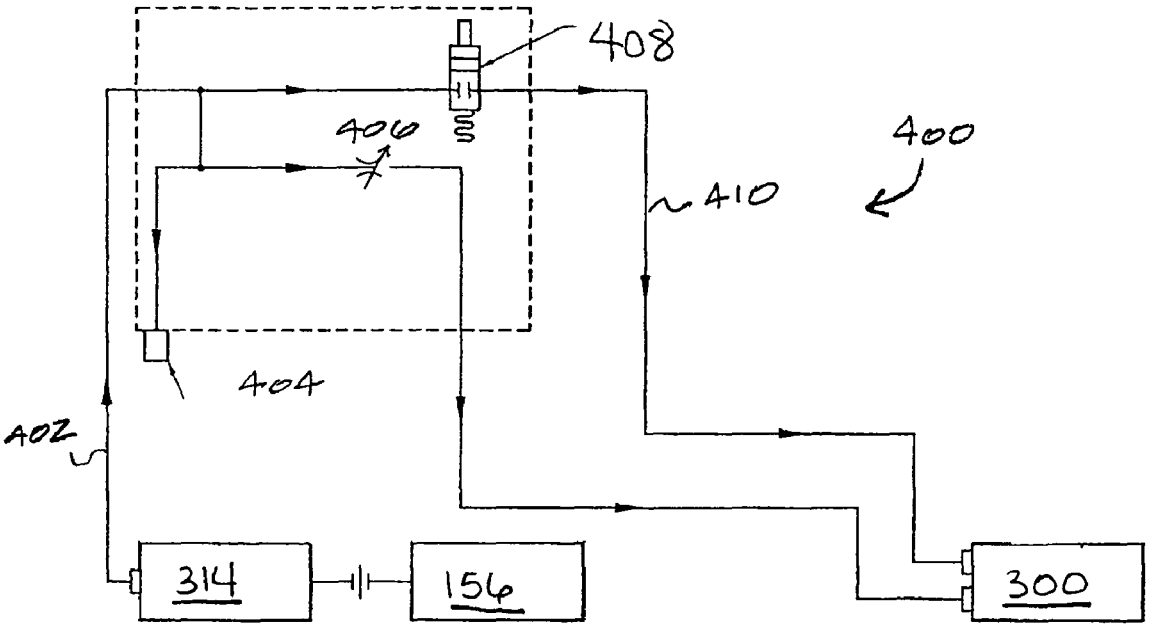
FIG. 6 illustrates in block diagram form one embodiment of a compressed air sub-system of the compressed air foam and high pressure liquid dispersal system of the present invention.

FIG. 6 illustrates in block form an embodiment 400 of the compressed air sub-system ("compressed air sub-system"). The compressed air system 400, includes an air compressor 314, such as Boss Industries' 35/175 rotary screw compressor, that preferably is a positive displacement, oil flooded system that uses two screws that have helical grooved rotors that mesh to produce pulse-free compressed air. The air compressor 314 is an encapsulated design, which means that the oil separator, filters, blow-down valve, pressure regulator valve and safety valve are integrated into the compressor package. This reduces the cost, size, weight and number of external connections thereby reducing the leak potential of the system. Oil is separated from the compressed air in an oil sump located in the compressor housing and the remaining droplets of oil are separated from the air by a coalescer filter. Oil is circulated through a cooling coil located in the cooling panel when the compressor is operating. The compressor is operated at preferably 5200 rpm, which produces preferably 28 cfm at preferably 100 psi and requires 7.0 shaft horsepower that is provided by the engine 157 of the power plant 156. The air compressor control system is designed to match air supply to air demand and to prevent excessive discharge pressure when there is no demand on the compressor has no demand. Control of the air delivery is accomplished by regulation of the inlet valve (not shown). The air compressor 314 features a minimum pressure valve (not shown) that serves to maintain a minimum discharge pressure of 80 psi to assure adequate compressor lubrication. A safety valve is set to relieve system pressure if the pressure exceeds 200 psi due to a mechanical malfunction.

Compressed air is supplied to the CAF sub-system 300 by lines 402. The line 402 feeds the auxiliary air chuck 404 for powering pneumatic tools and feeds the mixing manifold 312 of the CAF sub-system 300 via expansion air valve 406. Additionally, a control valve 408, such as electronic or solenoid, is provided to control the amount of compressed air going to the CAF pumps 308 of the CAF sub-system 300 via line 410.

Figure 7:
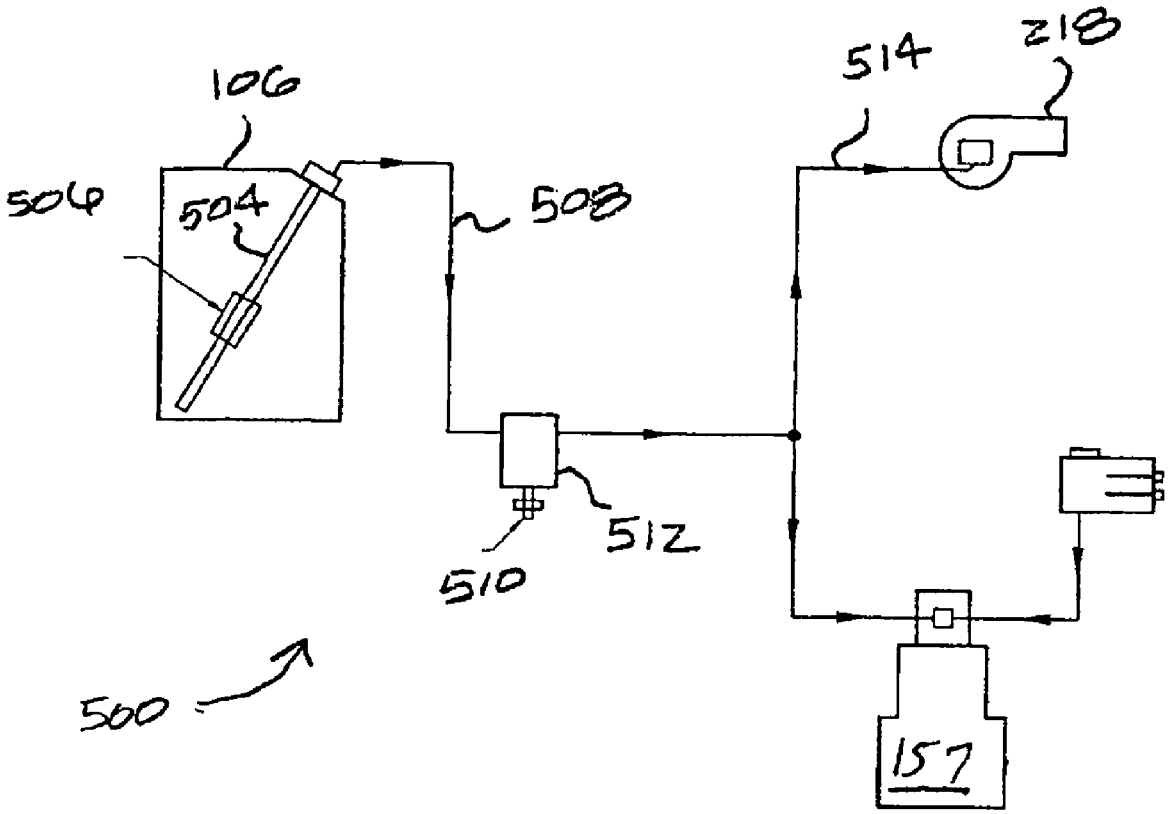
FIG. 7 illustrates in block diagram form one embodiment of a fuel sub-system of the compressed air foam and high pressure liquid dispersal system of the present invention.

FIG. 7 illustrates in block form an embodiment 500 of the fuel sub-system ("fuel sub-system"). The CAF/HPLD system 100 is designed to hold a fuel can 106, such as a 5-gallon NATO Jerry Can. The following fuels can be used by the engine 157: JP5, JP8, Commercial Diesel 1 (DF-1), and Commercial Diesel 2 (DF-2). A fuel pick-up unit 504 is inserted in the fuel can 106. A level sensor 506 incorporated in the pick-up unit 504 will indicate when the fuel level is low (approximately ½ gallon remaining). Fuel is drawn from the container by the mechanical fuel pumps of the engine 157 and/or burner 218. Fuel is filtered 512 and water is separated by a drain 510 from the fuel prior to being consumed.

Preferably, the multi-fuel engine 157 is a spark-ignited, carbureted, two-cycle diesel engine 157. The multi-fuel engine 157 may also be fuel injected. The engine 157 uses a small piston in the cylinder head to compress fuel to a very high pressure before the fuel is injected into the combustion chamber. The piston and injector timing are driven by a timing belt from the crankshaft of the engine 157. Because the engine 157 is a two-cycle design, oil must be injected into the fuel stream. The fuel to oil ratio is generally 50:1. Oil is contained in a 2-quart reservoir accessed from the top of the CAF/HPLD system 100. Oil is typically gravity fed to the engine oil pump. The oil reservoir preferably has two oil level switches. The higher switch warns of low oil level and the lower switch will shut down the engine 157 if injector oil is not added. Without the automatic shut-down feature, lack of injector oil could cause the engine 157 to fail. The engine 157 has an electric start with manual recoil starter as back-up. Depressing the start pushbutton will engage the electric starter to the engine 157. The engine 157 has its has its own starter and internal alternator. A glow-plug is provided for cold-start conditions.

An exemplary engine 157 is the model 215 MFLC—a two-cycle, single-cylinder, liquid-cooled, multi-fuel engine provided by Two Stroke International (2 si). The 2 si engine 157 is a low-compression lightweight industrial-duty engine 157 that uses spark plugs for ignition rather than high-compression ignition. The engine 157 provides the power for the following CAF/HPLD system 100 components, alternator, 24 VDC, 50 amp; air compressor 314, 28 cfm, 100 psi; • high pressure pump 210, with an output of typically 5.5 gpm and 1000 psi. The high pressure pump 210 is preferably driven through electric clutches that are disengaged during starting and only engaged when the high pressure pump 210 is required for the selected decontamination operation. The air compressor 314 is driven by a means of a coupling to a jack shaft to the engine 157. In addition, it also may include a centrifugal clutch.

Engine 157 speed is controlled by a throttle cable located to the right of the control panel 104. A choke cable is also provided to assist in starting the engine 157. The throttle cable features a detent system for setting engine speed at an optimal operating speed of preferably 4000 rpm. The engine 157 is liquid cooled and uses a 50% ethylene glycol based anti-freeze solution. Coolant is continuously circulated through a fan-cooled radiator on the cooling panel.

Two dry cell, maintenance-free batteries (not shown) are located inside the front panel 122. These long-life batteries provide the power to start the engine 157 via the electric starter. Additional features of the CAF/HPLD system 100 are a 24 VDC NATO connector that is connected to these batteries that may be used to jump start the system or dead batteries found in rolling stock on the decontamination line, charge the batteries, or to deliver up to 40 amps power for other purposes.

The control panel 104 for the CAF/HPLD system 100 contains the preferably following gauges and controls: emergency stop control, air pressure gauge, system power control, engine start and cold start control, mode selector (Start-Pressure Wash-CAF-Shower/Air), boiler temperature gauge, panel lights (includes a dimmer), engine tachometer, alarm silence switch, CAF expansion air adjustment controls, and auxiliary (used for auxiliary air and 24 VDC power applications).

Panel gauges allow a user to monitor air pressure, battery voltage, water pressure and water temperature as well as hours of use. Preferably, the panel gages are lighted for low-light operation. Warning lights on the panel indicate compressor and engine 157 over temperature, low fuel level and low injector oil. Illumination of any of the panel lights will also sound an audible alarm. The alarm silence switch can silence audible alarms.

Preferably, the emergency stop disconnects the system power de-energizing the air compressor and high-pressure water pump clutch, and engages the air blow-down valve. It also initiates an engine 157 kill function. Depressing the switch will de-energize the system causing immediate shut-down. The air pressure gauge indicates system air pressure. The battery voltage gauge indicates voltage level of the batteries and should preferably read between 24-28 volts. The warning lights compressor over temp indicator provides a visual indicator (yellow warning light) that the air compressor 314 oil is too hot. The engine over temp Indicator provides a visual indicator that the engine 157 coolant temperature is too hot. The indicator will show an alarm preferably at 230 F. The alarm will automatically shut the engine 157 ignition off. A low fuel indicator provides a visual indicator when fuel sub-system 500 is low on fuel and needs to be refueled. The low injector oil indicator indicates when the injection oil needs to be replenished. A second oil level switch automatically shuts the ignition off to protect the engine 157. The water pressure gauge indicates pressure of the high pressure sub-system 200. Typically, normal pressure is 1000 psi. The water temperature gauge indicates water temperature leaving the boiler. The boiler temperature control turns off heat and allows adjustment of the water temperature exiting the boiler. The CAF expansion valve control adjusts the level of foam expansion from a 1:1 ratio (unexpanded liquid) to 25:1 (highly expanded) foam. This control is adjusted to get the desired consistency of foam.

The Start/Idle control sets engine 157 speed to idle and disengages the high pressure pump clutch. The pressure wash control engages high pressure pump 210 and enables the burner 218 to operate if there is a demand for hot water. A CAF control engages the air compressor and activates the CAF pumps 308. A multi-mode controls preferably combines high pressure sub-system 200 and CAF sub-system for operating simultaneously.

The engine 157 also includes additional controls are located on the right hand side of the control panel 104. For example, a choke control for providing a manual choke to assist in cold weather starts and a throttle that is used to control engine speed. The CAF/HPLD system 100 further includes circuit breakers for protecting the electrical system and a governor to prevent over-revving of the engine.

For safety purposes, preferably, all hose connecting points are clearly labeled to avoid confusion. As a safety precaution, each connector is unique in size, thereby averting the possibility of connecting a hose to the wrong connecting point.

An exemplary disinfectant is the DF200 Liquid Multi-Part Blend decontamination solution developed by Sandia National Laboratories that will neutralize chemical and biological agents, rendering them harmless. Additionally, Penetrator Decontaminant Solution Part A is a liquid, when combined together with the Fortifier, makes up the active DF200 solution. Further, Fortifier Decontaminant Solution Part B is a liquid, when combined together with the Penetrator, makes up the active DF200 solution. Also, Booster Decontaminant Solution Part C is a liquid that excites the fortifier and makes it considerably more active in a shorter period of time. Another exemplary decontaminant is Reformulated Decon Green, which is a three part formulation and that is provided in a precise ratio mixed on demand by the CAF sub-system 300.

The term "binary" typically implies two (2), although this "binary" system actually has 3 components rather than just 2, it is still called a "binary blend" because Component A and Component B/C are used in equal quantities. The booster (Part C) is used in a much smaller quantity.

DF200 Decontamination Formula was developed by Sandia National Laboratories and is licensed for commercial manufacturing by these two companies exclusively, EFT, EnviroFoam Technologies, Inc of Huntsville, Ala., which markets it under the name EasyDECON™. The 3 components of the DF200 formulation are marked Part 1, Part 2, and Part 3 or Part A, Part B, and Part C, depending on the manufacturer. In addition to EFT, Modec, Inc. of Denver, Colo., markets it under the name of MDF200™. The 3 components of the DF200 formulation are market Part A, Part B, and Part C. Preferably, only mix and use components labeled A, B, and C together or components labeled 1, 2, and 3 together.

In addition to the aforementioned aspects and embodiments of the present CAF/HPLD system 100, the present invention further includes methods for washing and decontaminating rolling stock and the like.

In one embodiment, the CAF/HPLD system 100 is capable of mixing a binary or multiple-part decontaminant solutions such as DF-200 stored in 250-gallon totes 316 and 318. Two 40 foot ½-inch drafting hoses 320 and 322 are connected that have a plastic CAF quick connector on one end and a 2" female cam lever connector on the other end to draft from 250-gallon totes 316 and 318. The dust plugs are removed from the totes 316 and 318 and the 2" Female connector is connected to the to the totes 316 and 318. In another aspect, 50 gallon drum or pails may be used or Soap is be injected at the pressure wash outlet. If heated water is desired, the boiler temperature adjustment is turned on. Burner 218 will turn on when water is flowing. Additionally, if the CAF sub-system 300 is desired, the air compressor 314 will engage CAF pumps 308 and they will cycle (a pulsing sound by the pump air exhaust). The air control is adjusted if liquid decontaminant is desired (1:1). The adjust air control is further adjusted to produce foam. More air will yield a greater expansion ratio. Preferably, the maximum expansion is (1:25). The CAF/HPLD system 100 offers distinct advantages over other known aspirated foam methods, including visual reference for coated areas and the ability to adhere to surfaces to maintain required wet contact times. Further yet, the CAF/HPLD system 100 maintain the precise desired expansion ratios.

The Pressure Wash may be performed with hot or cold water. Soaps, cleaners and liquid decontaminants may be added to the pressure wash by the siphon injector, which is built into the high pressure sub-system 200. To add any of these liquids to the wash, simply place the injector plastic tube in the container of the desired liquid. To heat the Pressure Wash solution turn the temperature control valve on the control panel from "OFF" to the desired temperature. The boiler 116 will only work when water is flowing in the high pressure. The rolling stock, building, or aircraft is then power washed with either hot or cold high pressure water.

After, that the decontaminant is delivered by the CAF system is simply applied by squeezing the trigger on the CAF handset. The operator should choose the appropriate nozzle for the mission. It is preferable to open nozzle valves completely when applying foam since a partially opened valve will break the foam bubble structure and reduce the throw distance of both liquid and foam. An intact foam bubble structure is a key to good foam adhesion and overall decontamination effectiveness. The undercarriage nozzle is used to apply decontaminant in hard to reach places such as under a vehicle.

Although there has been described what is at present considered to be the preferred embodiments of the present compressed air foam and high pressure liquid dispersal system, it will be understood that the system can be embodied in other specific forms without departing from the spirit or essential characteristics thereof. For example, additional solutions, other than those described herein, for cleaning and decontaminating may be used. Also, other physical layouts of the components and sub-systems may be used other than those described herein without departing from the inventive novelty described herein. Further, the pressures, temperatures, volumes, solutions compositions can be increased, decreased, or changed without departing from the spirit or essential characteristics of the present compressed air foam and high pressure liquid dispersal system. In addition, those capacities and ratings of equipment and components described herein may also be increased, decreased, or changed without departing from the spirit or essential characteristics of the present compressed air foam and high pressure liquid dispersal system. The present embodiments are, therefore, to be considered in all aspects as illustrative and not restrictive. The scope of the invention is indicated by the appended claims rather than the foregoing description.

What is claimed:

1. A dispersal system for simultaneously delivering both a compressed air foam product and a high pressure liquid, comprising:

a compressed air foam product generation means, comprising:

concentrate delivery means for delivering a mixture of water and foam concentrate from a first tank to a mixing apparatus, additive delivery means for delivering a product additive, other than water or air, from a second tank to said mixing apparatus, wherein said mixing apparatus mixes said delivered product additive with said mixture of water and foam concentrate to produce a foam product liquid mixture, a constituent of which is said delivered product additive, expansion means for injecting compressed air into said foam product liquid mixture located in said mixing apparatus to produce said compressed air foam product, a constituent of which is said delivered product additive;

a high pressure liquid generation means, comprising:

liquid delivery means for delivering a liquid from a liquid reservoir, liquid pressurization means, responsive to receipt of said liquid, for generating a flow of high pressure liquid;

pump means for simultaneously delivering separate flows of said compressed air foam product and said high pressure liquid as an output from said dispersal system; and power source means for powering said compressed air foam product generation means and said high pressure liquid generation means.

2. The dispersal system of claim 1 wherein said concentrate delivery means and said additive delivery means comprises:

a first pump means powered by said power source means to draw said water and foam concentrate mixture and said product additive, other than water or air, at a controllable rate and pressure.

3. The dispersal system of claim 1 further comprises:

wherein said concentrate delivery means comprises a first pump means powered by said power source means to draw said water and foam concentrate mixture from a first tank to said mixing apparatus at a controllable rate and pressure; and wherein said additive delivery means comprises a second pump means powered by said power source means to draw said product additive, other than water or air, from a second tank to said mixing apparatus at a controllable rate and pressure.

4. The dispersal system of claim 3 wherein said first pump means and said second pump means comprises:

a pressurized gas operated pump means operated from a supply of pressurized gas to draw said water and foam concentrate mixture and said a product additive, other than water or air, at said controllable rate and pressure.

5. The dispersal system of claim 4 wherein said supply of pressurized gas comprises:

generating means for pressurizing a supply of said pressurized gas using an air compressor powered by said power source means.

6. The dispersal system of claim 1 further comprising:

additional pump means powered by said power source means to draw additional product additives, other than water or air, from an additional tank to said mixing apparatus at a controllable rate and pressure.

7. The dispersal system of claim 2 wherein said first pump means comprises:

a pressurized gas operated pump operated from a supply of pressurized gas to draw said water and foam concentrate mixture and said product additive, other than water or air, at said controllable rate and pressure.

8. The dispersal system of claim 7 wherein said supply of pressurized gas comprises:

generating means for pressurizing a supply of pressurized gas using an air compressor powered by said power source means.

9. The dispersal system of claim 1 wherein said liquid delivery means comprises:

high pressure pump means powered by said power source means to draw said liquid at a controllable rate and high pressure.

10. The dispersal system of claim 9 wherein said high pressure means comprises said high pressure pump means.

11. The dispersal system of claim 1 wherein said high pressure liquid generation means further comprises:

heater means for heating said high pressure liquid to a temperature above ambient temperature.

12. The dispersal system of claim 11 wherein said heater means comprises:

a high pressure liquid boiler.

13. The dispersal system of claim 12 wherein said high pressure liquid boiler means comprises:

fuel supply means for supplying a fuel for the operation of said high pressure liquid boiler for heating said high pressure liquid.

14. The dispersal system of claim 1 wherein said compressed air foam generation means comprises:

heater means for heating said foam liquid mixture to a temperature above ambient temperature.

15. The dispersal system of claim 1 wherein said power source means comprises an internal combustion engine.

16. The dispersal system of claim 15 wherein said power source means further comprises:

means for supplying a fuel for the operation of said internal combustion engine.

17. The dispersal system of claim 1 further comprising:

frame means for mounting said compressed air foam generation means and said high pressure liquid generation means in an integrated housing.

18. The dispersal system of claim 1 further comprising:

frame means for mounting said compressed air foam generation means, said high pressure liquid generation means, and said power source means in an integrated housing.

19. A method for simultaneously generating both a compressed air foam product and a high pressure liquid as an output from a dispersal system comprising:

producing, using a compressed air foam generation product apparatus, a compressed air foam product comprising:

delivering a mixture of water and foam concentrate from a first tank to a mixing apparatus, delivering a product additive, other than water or air, from a second tank to said mixing apparatus, mixing, using said mixing apparatus, said delivered product additive from said second tank with said mixture of water and foam concentrate from said first tank to produce a foam product liquid mixture, a constituent of which is said delivered product additive, injecting compressed air into said foam product liquid mixture located in said mixing apparatus to produce said compressed air foam product, a constituent of which is said delivered product additive;

producing, using a high pressure liquid generation apparatus, a high pressure liquid, comprising:

delivering said liquid from a liquid reservoir, generating a flow of high pressure liquid;

simultaneously delivering separate flows of said compressed air foam product and said high pressure liquid as an output from said dispersal system; and powering, using a power source, said compressed air foam product generation apparatus and said high pressure liquid generation apparatus.

20. The method of claim 19 wherein said step of delivering said water and foam concentrate mixtures and delivering a product additive comprises:

operating a first pump with said power source to draw said water and foam concentrate mixture and said product additive at a controllable rate and pressure.

21. The method of claim 19 wherein said step of delivering said water and foam concentrate mixtures and delivering a product additive comprises:

operating a first pump with said power source to draw said water and foam concentrate mixture at a controllable rate and pressure; and operating a second pump with said power source to draw said product additive, other than water or air, at a controllable rate.

22. The method of claim 21 wherein said step of operating said first pump and said second pump comprises:

providing a supply of pressurized gas; and operating a pressurized gas operated pump from said supply of pressurized gas to draw said water and foam concentrate mixture and said product additive at said controllable rate and pressure.

23. The method of claim 22 wherein said step of providing said supply of pressurized gas comprises:

generating a supply of said pressurized gas using an air compressor powered by said power source.

24. The method of claim 19 wherein said step of producing a compressed air foam further comprises:

delivering an additional product additive, other than water or air, from an additional tank to said mixing apparatus.

25. The method of claim 19 wherein said step of operating said first pump comprises:

providing a supply of pressurized gas; and operating a pressurized gas operated pump from said supply of pressurized gas to draw said water and foam concentrate mixture and said product additive at said controllable rate and pressure.

26. The method of claim 25 wherein said step of providing said supply of pressurized gas comprises:

generating a supply of said pressurized gas using an air compressor powered by said power source.

27. The method of claim 19 wherein said step of delivering said liquid from a liquid reservoir comprises:

operating a second pump with said power source to draw said liquid at a controllable rate and high pressure.

28. The method of claim 27 wherein said high pressure means comprises said second pump.

29. The method of claim 19 wherein said step of delivering said high pressure liquid further comprises:

heating said high pressure liquid to a temperature above ambient temperature.

30. The method of claim 29 wherein said step of heating said high pressure liquid to a temperature above ambient comprises:

heating said high pressure liquid in a boiler.

31. The method of claim 30 wherein said step of heating said high pressure liquid further comprises:

supplying a fuel for the operation of said boiler for heating said high pressure liquid.

32. The method of claim 19 wherein said step of powering comprises:

operating an internal combustion engine.

33. The method of claim 32 wherein said step of operating said internal combustion engine comprises:

supplying a fuel for the operation of said internal combustion engine.

34. The method of claim 19 wherein said step of producing, using a compressed air foam apparatus, a compressed air foam further comprises:

heating said foam liquid mixture to a temperature above ambient temperature.

35. The method of claim 19 further comprising:

mounting said compressed air foam generation apparatus and said high pressure liquid generation apparatus in an integrated housing.

36. The method of claim 19 further comprising:

mounting said compressed air foam generation apparatus, said high pressure liquid generation apparatus, and said power source in an integrated housing.

37. A compressed air foam product and high pressure liquid dispersal system comprising:

a compressed air foam product sub-system, comprising:

a first pump for delivering a mixture of water and foam concentrate from a first container to a mixing manifold, a second pump for delivering a product additive, other than water or air, from a second container to said mixing manifold, wherein said mixing manifold mixes said delivered product additive with said mixture of water and foam concentrate to produce a foam product liquid mixture, a constituent of which is said delivered product additive, an air compressor for injecting compressed air into said foam product liquid mixture located in said mixing manifold to produce said compressed air foam product, a constituent of which is said delivered product additive, said air compressor further powering said first and said second pumps, at least one hose connected to said mixing manifold for delivering said compressed air foam product as a first output from said dispersal system;

a high pressure sub-system for simultaneously providing a high pressure liquid separate from said compressed air foam product as an output from said dispersal system, comprising:

a third pump for delivering a liquid from a liquid reservoir at a high pressure to generate said high pressure liquid, a heater in communication with said third pump for heating said high pressure liquid, at least one hose connected to said heater for delivering said high pressure liquid as a second output from said dispersal system simultaneously with said first output from said dispersal system;

a power plant for powering said air compressor and said third pump; and a fuel delivery apparatus for delivering fuel to said power plant and said heater.

38. The dispersal system of claim 37 wherein said power plant is an internal combustion engine.

39. The dispersal system of claim 37, further comprising:

an air chuck connected to said air compressor for providing power for at least one pneumatic tool.

40. The dispersal system of claim 37, further comprising:

frame means for mounting said compressed air foam sub-system and said high pressure sub-system in an integrated housing.

41. The dispersal system of claim 37, further comprising:

frame means for mounting said compressed air foam sub-system, said high pressure sub-system, and said power plant in an integrated housing.

* * * * *